United States Patent [19]

Evans

[11] 4,373,307

[45] Feb. 15, 1983

[54] ADJUSTABLE EARTHQUAKE BACKSTOP SUPPORT FOR MOBILE HOMES

[75] Inventor: George Q. Evans, Paramount, Calif.

[73] Assignee: Earthquake Preparedness Co., Inc., Paramount, Calif.

[21] Appl. No.: 251,503

[22] Filed: Apr. 6, 1981

[51] Int. Cl.[3] ..... E04D 15/00

[52] U.S. Cl. ..... 52/167; 52/122.1; 52/126.1; 52/126.5

[58] Field of Search ..... 52/167, 122.1, 126.1, 52/126.5, 573; 248/157, 421

[56] References Cited

U.S. PATENT DOCUMENTS

| | | | |
|---|---|---|---|
| 1,706,496 | 3/1929 | Pieri | 52/167 X |
| 3,604,166 | 9/1971 | Ciccarelli | 52/122.1 X |
| 4,014,517 | 3/1977 | Keagle | 52/126.1 X |
| 4,125,975 | 11/1978 | Soble | 52/126.1 |
| 4,126,972 | 11/1978 | Silen | 52/167 X |
| 4,192,623 | 3/1980 | Borg | 52/126.5 X |
| 4,320,607 | 3/1982 | Eubank | 52/126.6 |

*Primary Examiner*—J. Karl Bell

*Attorney, Agent, or Firm*—Harlan P. Huebner

[57] ABSTRACT

An earthquake backstop support for mobile homes includes a cross-beam which underlies the pier-supported underframe of the home in closely spaced relationship to, but separated from, the underframe. In the event of displacement of the home from its piers, the beams of the backstop support support it in a level attitude and are carried on slidable shoes so as to permit sliding movement during continuing earthquake shocks.

6 Claims, 6 Drawing Figures

FIG. 1.
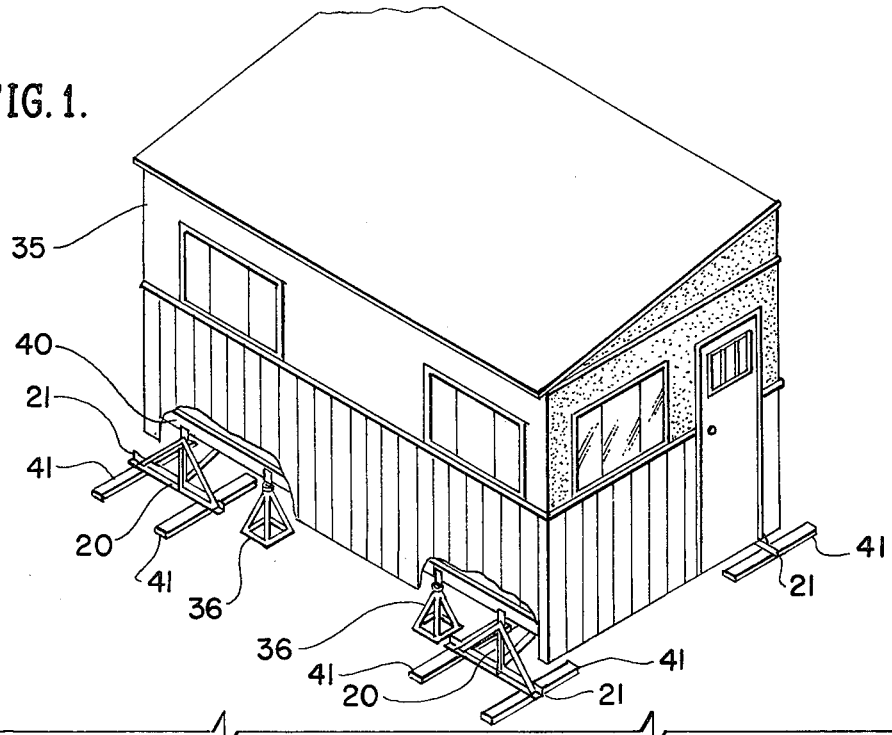
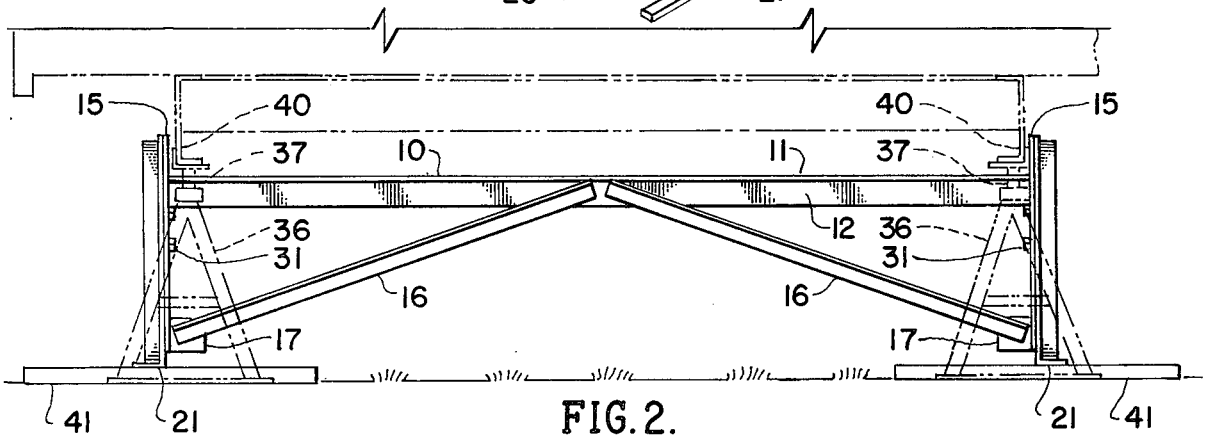
FIG. 2.
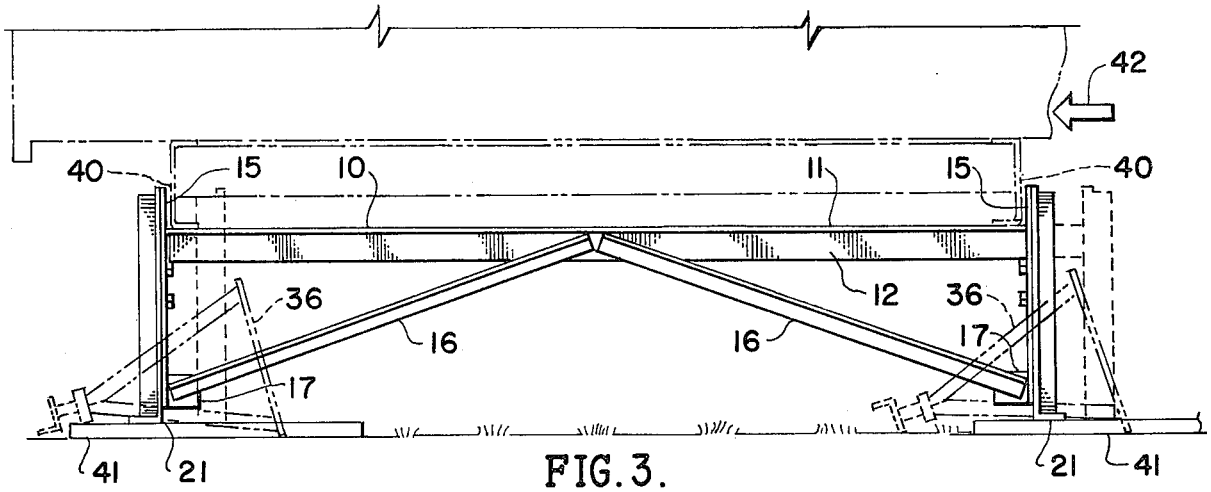
FIG. 3.

ADJUSTABLE EARTHQUAKE BACKSTOP SUPPORT FOR MOBILE HOMES

BACKGROUND OF THE INVENTION

1. Field of the Invention

The present invention is directed to improvements in static structures; e.g., buildings and, more particularly, to a support for mobile homes designed to serve as a backstop to their normal support under earthquake, high wind, earth slide conditions, or the like.

2. Description of the Prior Art

Previous efforts to provide for the stabilization of mobile homes or their supports under such conditions have been directed toward reinforcing their supports and/or cushioning the impact of the forces encountered. Examples of such approaches are currently being advertised under the name "Quakebrace", which is a trussed steel frame designed to replace standard sized piers, and the "Fall-Stop" system designed to re-direct vertical forces laterally into the mobile home's frame in order to provide a cushioning effect.

Since the strengthening provided by such approaches necessarily is limited while the destabilizing forces which may be encountered are not, a need has existed for a new approach to mobile home stabilization not subject to such limitations.

SUMMARY OF THE INVENTION

According to the present invention, a mobile home having the usual rectangular under-frame normally is supported by the usual screw-jacks carried by piers; the support of the present invention serving as a backstop upon displacement of the underframe from its normal supports.

This novel backstop support, which is employed in numbers dependent upon the dimensions of the structure being supported, comprises, in each unit, a cross-beam designed to be supported in a position closely adjacent but not necessarily in actual contact with the under side of the mobile home's underframe. End plates include portions which extend upwardly of this cross-beam adjacent its ends to prevent relative longitudinal displacement of the beam and underframe.

The cross-beam is supported at a desired height by a pair of end supports each having a base comprising an elongate shoe extending transversely with respect to the cross-beam and having a flat under surface designed for sliding movement over an underlying support surface. Each end support includes also a centrally located upwardly extending cross-beam support plate which is provided with a series of vertically spaced holes capable of being aligned with similar holes in the cross-beam's end plates so that by passing bolts through pairs of aligned holes the cross-beam may be supported at selected stepped heights.

In use, the backstop support of the present invention is brought into position only after the mobile home has been mounted on the usual piers and leveled by the usual screw-jacks. At such time the end supports of the present invention are positioned opposite each other at the sides or ends of the underframe, in such numbers as dictated by the dimensions of the underframe. Cross-beams then are supported upon the end supports at heights closely adjacent, but not necessarily in contact with, the underframe.

In the event of an occurrence such as an earthquake of sufficient intensity to displace the mobile home from its supporting jacks and piers, the home's underframe may fall only a fraction of an inch to an inch or two onto the cross-beams where, constrained by the end plates, it may slide the entire structure upon the shoes of the end supports to an extent dependent upon the force exerted; in any event remaining as level as is the underlying surface.

Upon cessation of the disturbance, the home may be readily restored to its original position and re-leveled by replacing the piers and screw jacks in their original positions.

BRIEF DESCRIPTION OF THE DRAWINGS

FIG. 1 is a view in perspective, of a mobile home supported on the usual piers and jacks, showing the backstop supports of the present invention in position;

FIG. 2 is a view in side elevation of the backstop support of the present invention showing its initial positioning with respect to a mobile home underframe supported on piers and jacks;

FIG. 3 is a view in side elevation corresponding to FIG. 2 but showing the positioning of the backstop support with respect to the underframe upon displacement of the latter from the piers and jacks;

DESCRIPTION OF THE PREFERRED EMBODIMENT

Figure 4:
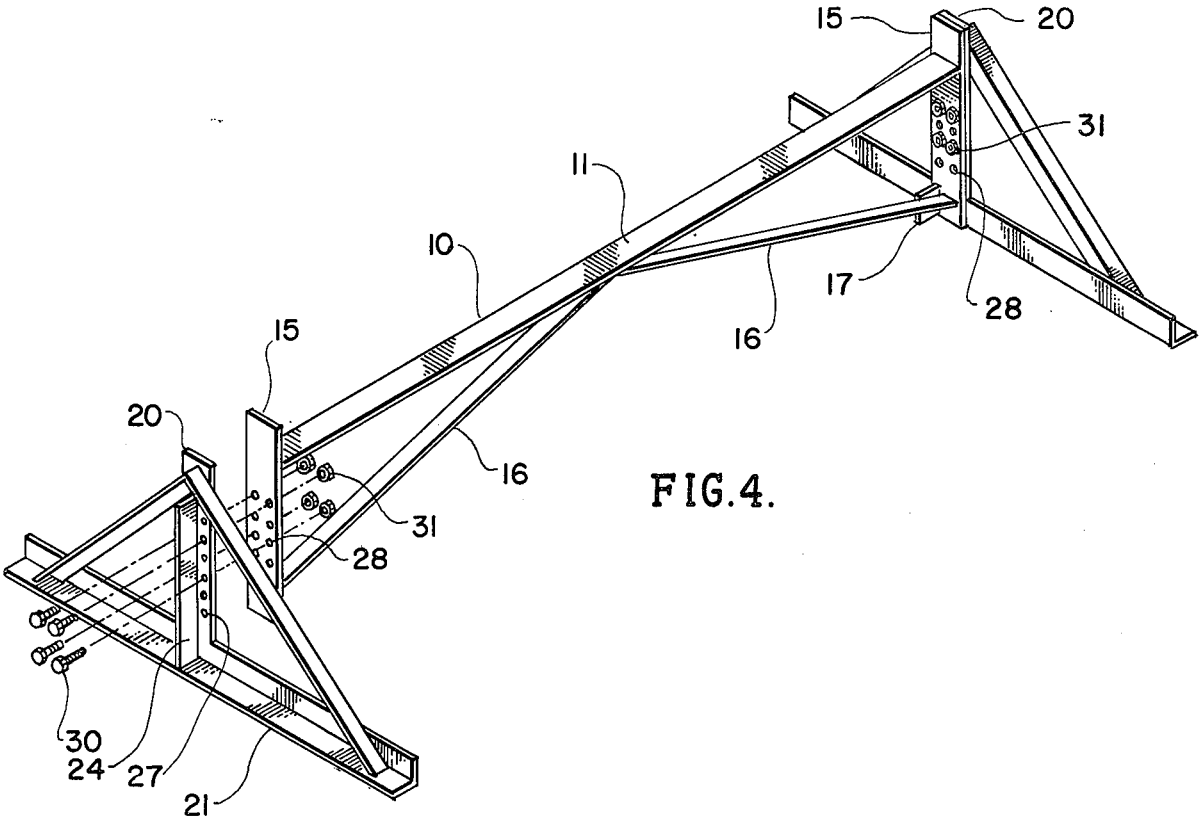
FIG. 4 is a view in exploded perspective of the backstop support of the present invention.
Figure 5:
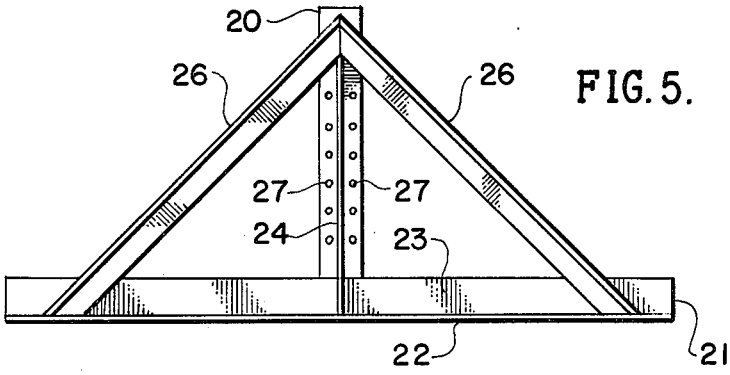
FIG. 5 is a detail view in end elevation of an end support of the present invention.
Figure 6:
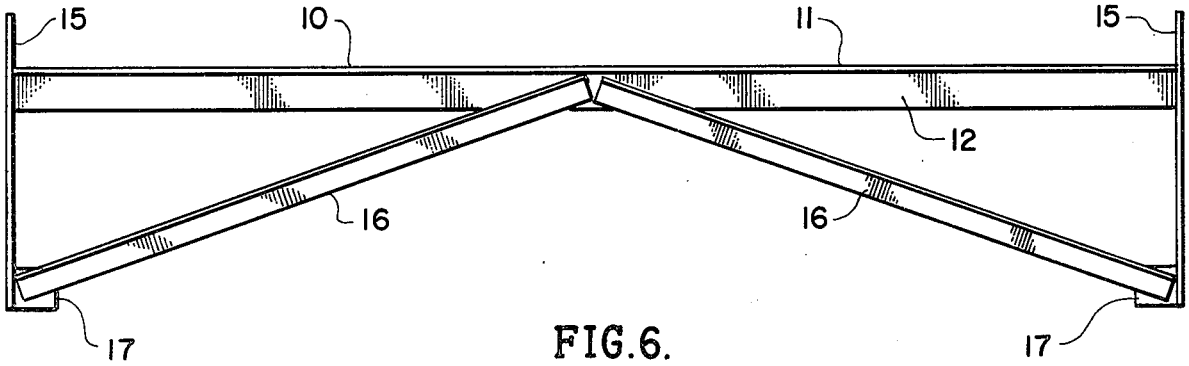
FIG. 6 is a detail view in side elevation of a cross-beam and end plate assembly of the present invention.

The adjustable earthquake backstop support of the present invention, in its preferred form, includes a cross-beam 10 in the form of an angle iron presenting a horizontal upper surface 11 and a vertical flange 12. Vertical end plates 15 portions of which extend upwardly with respect to the upper surface 11 of the beam are welded to the opposite ends of beam 10 and a trussed structure is formed by angle irons 16 welded at one end to the flange 12 centrally thereof and at their opposite ends to flanges 17 welded to the bases of end plates 15.

A pair of end supports for the cross-beam 10 are provided in the form of a cross-beam support plate 20 welded at its lower end to a base in the form of an elongated horizontal shoe 21 shown as an angle iron presenting a flat under surface 22 and a vertical flange 23. The horizontal dimension of the shoe 21 should be sufficient to afford a stable base for the entire assembly and, in practice, a shoe length of four feet in relation to a support plate height of twenty-one inches has been found satisfactory. This structure is reenforced by a stiffening strut 24 welded to the plate 20 centrally of the outside surface thereof and by angle irons 26 welded to the plate 20 at their upper ends and to flange 23 at their lower ends.

Adjustable means are provided for interconnecting the end plates 16 with the support plates 20 to position the end plates 15 and thus the cross-beam 10 at selected stepped heights with respect to the support plates 20. For this purpose, each of the support plates 20 is provided with a series of vertically spaced bolt holes 27 and each of the end plates 15 is provided with a series of bolt holes 28 so arranged as to be capable of alignment with the bolt holes 27. Bolts 30 are provided which may be passed through any pair of aligned holes 27 and 28 and secured by nuts 31 to secure the cross-bar 10 to the support plates 20 in any elevated position of the cross bar permitted by the spacing of the holes 27. In practice it has been found satisfactory to separate the holes 27 vertically by about two inches.

In the practicable employment of the device of the present invention, the mobile home, such as is shown at 35 in FIG. 1, first is supported in the normal manner by four or more piers 36 carrying screw jacks 37 (see also FIG. 2) which contact the underframe 40 and which may be vertically adjusted to level the home.

Then, two or more of the backstop supports of the present invention are positioned beneath the underframe 40, as shown in FIG. 1, preferably with the shoes 21 of their end supports resting upon a level surface upon which they may slide, such as a surface provided by wooden two-by-sixes 41. The height of the cross-bar 10 is then adjusted as described above, so that the horizontal upper surface 11 of cross bar 10 lies closely adjacent but out of contact with the under surface of the mobile home underframe 40, as shown in FIG. 2, and the upper portions of the end plates 15 lie outside of the underframe 40, bracketing the same.

When forces are exerted against the mobile home sufficient to displace it from the piers 36, as indicated by the arrow 42 in FIG. 3, the underframe 40 will descend only a short distance, such as a maximum of the distance between holes 27 until it comes to rest on the cross-beam 10 as shown in FIG. 3 where it will be sustained in stable equilibrium. Thereafter, if the forces continue to be exerted, movement in any direction upon the shoes 21 sliding on their supporting surfaces will not result in upsetting the mobile home, since the underframe 40 is bracketed by the upper portions of end plates 15 causing the mobile home and backstop support to move together.

I claim:

1. A backstop support for a mobile home having an underframe; said support comprising a cross-beam, adjustable means for supporting said cross-beam in a position underlying but spaced from said underframe, and means for preventing relative displacement of said cross-beam and underframe longitudinally of said cross-beam when said cross-beam is supported in said position.

2. A backstop support according to claim 1 in which said last-named means comprises end plates secured to said beam and having portions extending upwardly with respect to said beam into positions in which they bracket said underframe when said cross-beam is supported in said position.

3. A backstop support according to claim 1 in which said first-named means comprises a pair of end supports for said cross-beam each including an elongated shoe having a flat under surface adapted for sliding movement over an underlying support.

4. A backstop support according to claim 2 in which said first-named means comprises a pair of end supports for said cross-beam each including an elongated shoe having a flat under surface adapted for sliding movement over an underlying support.

5. A backstop support according to claim 1 in which said first-named means includes end plates secured to said beam, paralleling support plates, and means for interconnecting said plates in selected relatively offset relationships to support said beam at selected heights.

6. A backstop support according to claims 2, 3 or 4 in which said first-named means includes end plates secured to said beam, paralleling support plates, and means for interconnecting said plates in selected relatively offset relationships to support said beam at selected heights.

* * * * *